US007488562B2

(12) United States Patent
Daimon et al.

(10) Patent No.: US 7,488,562 B2
(45) Date of Patent: Feb. 10, 2009

(54) ELECTROPHOTOGRAPHIC TONER, METHOD FOR PRODUCING THE SAME, ELECTROPHOTOGRAPHIC DEVELOPER, METHOD FOR PRODUCING THE DEVELOPER, AND IMAGE FORMING METHOD

(75) Inventors: Katsumi Daimon, Minamiashigara (JP); Shuji Sato, Minamiashigara (JP); Shigeru Hayashi, Minamiashigara (JP); Yosuke Tsurumi, Minamiashigara (JP); Yusuke Ikeda, Minamiashigara (JP); Hiroshi Nakazawa, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 545 days.

(21) Appl. No.: 11/299,625

(22) Filed: Dec. 13, 2005

(65) Prior Publication Data

US 2006/0292477 A1 Dec. 28, 2006

(30) Foreign Application Priority Data

Jun. 27, 2005 (JP) ..... 2005-187413

(51) Int. Cl.
*G03G 9/08* (2006.01)

(52) U.S. Cl. ..... 430/109.1; 430/109.4

(58) Field of Classification Search ..... 430/109.1, 430/109.4
See application file for complete search history.

(56) References Cited

U.S. PATENT DOCUMENTS 5,057,392 A * 10/1991 McCabe et al. ..... 430/109.2

FOREIGN PATENT DOCUMENTS

| | | |
|---|---|---|
| JP | B-42-023910 | 11/1967 |
| JP | B2-56-013943 | 4/1981 |
| JP | B2-62-039428 | 8/1987 |
| JP | B2-63-025335 | 5/1988 |
| JP | A-2004-191927 | 7/2004 |

* cited by examiner

*Primary Examiner*—Mark A Chapman
(74) *Attorney, Agent, or Firm*—Oliff & Berridge, PLC

(57) ABSTRACT

Provided are an electrophotographic toner, comprising a binder resin containing a coloring agent, a crystalline resin and an amorphous resin, wherein the crystalline resin has two or more peaks in weight-average molecular weight as determined by gel permeation chromatography, one of the peaks has a weight-average molecular weight in the range of 15,000 to 40,000, and another peak has a weight-average molecular weight in the range of 2,000 to 10,000 and a production method thereof, and an electrophotographic developer and an image-forming process using the electrophotographic toner.

14 Claims, No Drawings

ELECTROPHOTOGRAPHIC TONER, METHOD FOR PRODUCING THE SAME, ELECTROPHOTOGRAPHIC DEVELOPER, METHOD FOR PRODUCING THE DEVELOPER, AND IMAGE FORMING METHOD

CROSS-REFERENCE TO RELATED APPLICATION

This application claims priority under 35 USC 119 from Japanese Patent Application No. 2005-187413, the disclosure of which is incorporated by reference herein.

BACKGROUND OF THE INVENTION

1. Field of the Invention

The present invention relates to an electrophotographic toner for use in electrophotographic apparatuses which utilize an electrophotographic process such as copying machines, printers, facsimiles, and the like, a production method thereof, an electrophotographic developer, and an image-forming process using the toner.

2. Description of the Related Art

Many electrophotographic methods are already known (see, for example, Japanese Patent Application Publication (JP-B) No. 42-23910). Generally, a fixed image is formed after undergoing the plural steps in which a latent image is electrostatically formed by various means on a surface of a photosensitive body (latent image carrier) which utilizes a photoconductive substance, the formed latent image is developed using electrophotographic toner (hereinafter, referred to as simply "toner") to form a toner image, the toner image on the surface of the photosensitive body is transferred onto a surface of a recording material such as paper or the like, and this transferred image is fixed by compression or thermocompression and solvent vapor, etc. Toner remaining on the surface of the photosensitive body is cleaned, as required, by various methods and is again supplied for the aforementioned plural steps.

As a fixing technique for fixing a transfer image which has been transferred onto a surface of a recording material, a heat roll fixing method of inserting a transferable body onto which a toner image has been transferred between a pair of rolls composed of a heating roll and a pressure roll to fix the image is common. In addition, as a similar technique, a technique in which one or both of the rolls is substituted with a belt is also known. Compared to other fixing means, these techniques provide an image that is firmly fixed at high speed, have a high energy efficiency, and cause minimal damage to the environment due to volatilization of solvent or the like.

On the other hand, a technique for fixing toner using less energy is desired in order to reduce the amount of energy usage in copying machines and printers. For this reason, there is a strong demand for an electrophotographic toner which can be fixed at a lower temperature.

As a method of lowering the toner fixing temperature, a technique of lowering the glass transition point of a toner resin (binder resin) is commonly used. However, when the glass transition point is too low, since aggregation of powder (blocking) occurs easily and retainability of toner on the surface of a fixed image is lost, the lower limit in practical terms is 50° C. This glass transition point is a design feature of toner resins which are currently widely sold, and there has been a problem that in the methods for lowering the glass transition point it has not been possible to obtain a toner with a lower glass transition point than at present. In addition, although the fixing temperature can be lowered using a plasticizer, there have been problems of blocking occurring during storage of toner or in a developing device.

As a means for preventing blocking and realizing both image retainability up to 60° C. and low temperature fixability, a technique using a crystalline resin as a binder resin constituting a toner has been considered, and a method of using a crystalline resin as a toner for the purpose of realizing both blocking prevention and low temperature fixing has been long known (see, for example, JP-B No. 56-13943). In addition, for the purpose of offset prevention and compression fixing, a technique of using a crystalline resin has been long known (see, for example, JP-B Nos. 62-39428 and 63-25335).

However, when a crystalline resin is used alone, the strength of the crystalline resin is lower than that of amorphous resins and the crystalline resin has a problem of low powder reliability. In particular, problems of storage at a high temperature, blocking occurring in a developing device, and filming occurring on a photosensitive drum easily arise.

For improving the strength of binder resin, a method of mixing a crystalline resin and an amorphous resin was disclosed, and a toner comprising a crystalline polyester and an amorphous resin that does not have the crystalline resin in the surface layer has been proposed (e.g., Japanese Patent Application Laid-Open (JP-A) No. 2004-191927) in which it is possible to improve the low-temperature fixing efficiency and the image strength at the same time. However, in recent years, there is a need to obtain an image close to a photographic-quality image, i.e., an image having a higher glossiness such as that of gravure printing, even if low-temperature fixing is carried out, and the method above is still unsatisfactory for that purpose and needs to be improved.

SUMMARY OF THE INVENTION

The present invention, which was made to solve the problems up to date, provides an electrophotographic toner having a preferable low-temperature fixing efficiency and giving a high-strength and high-glossiness image, a production method thereof, and an electrophotographic developer and an image-forming process using the electrophotographic toner.

A first aspect of the present invention is to provide an electrophotographic toner, comprising a binder resin containing a coloring agent, a crystalline resin and an amorphous resin, wherein the crystalline resin has two or more peaks in weight-average molecular weight as determined by gel permeation chromatography, one of the peaks has a weight-average molecular weight in the range of 15,000 to 40,000, and another peak has a weight-average molecular weight in the range of 2,000 to 10,000.

A second aspect of the present invention is to provide an electrophotographic toner according to the first aspect, wherein the crystalline resin contains a high-molecular weight resin having a peak in the weight-average molecular weight range of 15,000 to 40,000, a low-molecular weight resin having a peak in the weight-average molecular weight range of 2,000 to 10,000, and the high- and low-molecular weight resins are prepared respectively from different monomers.

A third aspect of the present invention is to provide an electrophotographic toner according to the first aspect, wherein the crystalline resin is an aliphatic polyester.

A fourth aspect of the present invention is to provide an electrophotographic toner according to the third aspect, wherein the ester concentration of the crystalline polyester represented by the following Formula 1 is 0.01 or more and 0.1 or less:

$$M=K/A \quad \text{(Formula 1)}$$

(in Formula 1, M represents an ester concentration, K represent the number of ester groups in the resin, and A represents the number of atoms constituting the polymer chain in the resin).

A fifth aspect of the present invention is to provide an electrophotographic toner according to the first aspect, wherein the amorphous resin is a polyester.

A sixth aspect of the present invention is to provide an electrophotographic toner of according to the fifth aspect, wherein the amorphous polyester resin has a weight-average molecular weight Mw of from 5,000 to 40,000 and a number average molecular weight Mn of from 2,000 to 10,000.

A seventh aspect of the present invention is to provide an electrophotographic toner of according to the fifth aspect, wherein the amorphous polyester resin has a glass transition temperature of 30° C. to 80° C.

An eighth aspect of the present invention is to provide an electrophotographic toner according to the first aspect, wherein the content of the crystalline resin is a resin obtained by polymerizing a monomer having vinyl monomers.

A ninth aspect of the present invention is to provide an electrophotographic toner according to the eighth aspect, wherein the resin obtained by polymerizing a monomer having vinyl monomers has a weight average molecular weight Mw of from 20,000 to 100,000 and a number average molecular weight Mn of from 2,000 to 30,000.

A tenth aspect of the present invention is to provide an electrophotographic toner according to the first aspect, wherein the content of the crystalline resin is about 5% or more and about 35% or less by weight with respect to the total amount of the binder resin.

An eleventh aspect of the present invention is to provide an electrophotographic toner according to the first aspect, wherein the electrophotographic toner has a core/shell structure consisting of a core region and a shell region containing an amorphous resin as the main component, and the amorphous resins used in the core and shell regions are prepared respectively by polymerizing monomers which are different from each other.

A twelfth aspect of the present invention is to provide an electrophotographic toner according to the eleventh aspect, wherein the thickness of the shell region is about 0.05 to 0.5 μm.

A thirteenth aspect of the present invention is to provide an electrophotographic toner according to the eleventh aspect, wherein the difference between the SP value of the amorphous resin in the core region and the SP value of the amorphous resin in the shell region is 0.5 or less.

A fourteenth aspect of the present invention is to provide an electrophotographic toner according the first aspect, wherein the toner is prepared by an aggregation process in which aggregated particles containing crystalline particles and amorphous particles are formed in a dispersion containing the crystalline particles and the amorphous particles A fifteenth aspect of the present invention is to provide an electrophotographic toner according to the thirteenth aspect, wherein the toner is prepared through a deposition process of depositing amorphous resin particles on the surface of the aggregated particles after the aggregation process.

A sixteenth aspect of the present invention is to provide an electrophotographic developer comprising a carrier containing a magnetic body and the electrophotographic toner according to the first aspect.

A seventeenth aspect of the present invention is to provide an electrophotographic developer according to the sixteenth aspect, wherein the carrier is coated with a resin having a coated amount of about 0.1 to 10 parts by weight relative to 100 parts of the magnetic body.

An eighteenth aspect of the present invention is to provide an image-forming process employing the electrophotographic toner of claim 1, wherein the process comprises a latent image-forming step of forming an electrostatic latent image on the surface of a latent image carrier, a developing step of forming a toner image by developing the electrostatic latent image formed on the surface of the latent image carrier with a developer containing a toner, a transferring process of transferring the toner image formed on the latent image carrier surface onto the surface of an image-receiving member, and a fixing step of thermally fusing the toner image transferred on the surface of the image-receiving member, wherein the toner is an electrophotographic toner according to the first aspect.

DETAILED DESCRIPTION OF THE INVENTION

The electrophotographic toner according to the present invention has a binder resin containing a coloring agent, a crystalline resin and an amorphous resin, and the crystalline resin has at least two peaks respectively in the weight-average molecular weight ranges of 15,000 to 40,000 and 2,000 to 10,000.

Hereinafter, in describing the invention in detail, the components used for the electrophotographic toner according to the invention will be first described in detail.

<Binder Resin>

The binder resin according to the invention preferably has a crystalline resin content of 5% by weight or more and 35% by weight or less and more preferably 10% by weight or more and 30% by weight or less. A ratio of the crystalline resin in the total binder resin components at 5% by weight or more is effective in improving the efficiency of low-temperature fixing, while a ratio of 35% by weight or less is effective in improving the strength of the toner and image and preventing collapse of the toner in developing device or between blades and separation of the image which often occurs when scratched, for example, with hard metal.

(Crystalline Resin)

As described above, the crystalline resin according to the invention should have at least two peaks in weight-average molecular weight as determined by gel permeation chromatography (GPC), and one peak corresponds to a weight-average molecular weight in the range of 15,000 to 40,000 (hereinafter, referred to as "high-molecular weight range"), and another peak corresponds to a weight-average molecular weight in the range of 2,000 to 10,000 (hereinafter, referred to as "low-molecular weight range"). Use of a crystalline resin having peaks in the high- and low-molecular weight ranges allows low-temperature fixing efficiency and gives an image higher in strength and glossiness.

As for the high-molecular weight range, the weight-average molecular weight is more preferably 20,000 to 35,000, particularly preferably 22,000 to 30,000, for controlling deterioration in glossiness favorably and giving a high-strength image. Further, as for low-molecular weight range, the weight-average molecular weight is more preferably 3,000 to 8,000, particularly preferably 4,000 to 6,000, in light of preventing deterioration of image strength sufficiently and obtaining a highly glossy image.

The crystalline resin having peaks in the high- and low-molecular weight ranges is, for example, a crystalline resin containing a resin having a weight-average molecular weight of 15,000 to 40,000 (hereinafter, referred to as "high-molecular weight polymer") and a resin having a weight-average molecular weight of 2,000 to 10,000 (hereinafter, referred to as "low-molecular weight polymer").

Both of the high- and low-molecular weight polymers can be prepared from the monomers described below (acid and alcohol components for constituting a crystalline polyester), but the polymers in the crystalline resin according to the invention are preferably prepared from different monomers, respectively, and, for example, when the crystalline polymer is a copolymer of two or more monomers, each of the polymers preferably contain at least one different monomer. Use of different monomers is effective for obtaining a fixed image having a higher glossiness.

The weight ratio of the high-molecular weight polymer to the low-molecular weight polymer in crystalline resin is preferably in the range of 1/2 to 2/1 and more preferably 1/1. Presence of the low-molecular weight polymer in excess causes deterioration of image strength, while presence of the high-molecular weight polymer in excess causes difficulties in improving glossiness.

-Method of Determining Molecular Weight-

The weight-average molecular weight is determined according to the following method: Gel permeation chromatography (GPC) was performed by using HLC-8120GPC, SC-8020 (manufactured by Tosoh Corp.); the columns used were TSK gel and Super HM-H (manufactured by Tosoh Corp., 6.0 mmID×15 cm), and the eluant, THF (tetrahydrofuran). A typical experiment is carried out under the condition that the sample concentration is 0.5% by weight; flow rate is 0.6 ml/min, sample injection is 10 μl, and measuring temperature is 40° C. An IR detector is used for detection. The calibration curve is prepared by using 10 polystyrene standard samples: "TSK Standards": "A-500", "F-1", "F-10", "F-80", "F-380", "A-2500", "F-4", "F-40" "F-128", and "F-700", manufactured by Tosoh Corp.

In the invention, "crystalline" in "crystalline polyester resin" refers to not a stepwise change in endotherm but presence of a clear endothermic peak in a differential scanning calorimetery (DSC). In addition, an endothermic peak may refer to a peak having a width of 40 to 50° C. when formulated into a toner.

As the crystalline resin (including a high molecular weight resin and low molecular weight resin), a crystalline polyester is preferably used. In the present invention, in the case of a polymer in which other component is copolymerized with the main chain of the polyester, when the other component is 50% or less by weight, this copolymer is also called a crystalline polyester.

(Crystalline Polyester)

The crystalline polyester is a particular polyester prepared from an acid (dicarboxylic acid) component and an alcohol (diol) component. In the description of the polyester resin below, the configurational unit that was an acid component before synthesizing the polyester will be referred to as an "acid-derived component", and the configurational unit that was an alcohol component before synthesizing the polyester as an "alcohol-derived component".

-Acid-derived Component-

Examples of the acids for the acid-derived component include various dicarboxylic acids, and the main acid-derived component in the particular polyester is preferably a fatty dicarboxylic acid or an aromatic dicarboxylic acid; and in particular, the fatty dicarboxylic acid is preferably a linear carboxylic acid.

Examples of aliphatic dicarboxylic acid include oxyalic acid, malonic acid, succinic acid, glutaric acid, adipic acid, pimelic acid, suberic acid, azelic acid, sebacic acid, 1,9-nonane dicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and a lower alkyl ester or an acid-anhydride thereof, being not limiting. Among them, in view of easy availability, sebacic acid, and 1,1-decanedicarboxylic acid are preferable.

In the present invention, an aromatic dicarboxylic acid may be copolymerized. Examples of the aromatic dicarboxylic acid include terephthalic acid, isophthalic acid, orthophthalic acid, t-butylisophthalic acid, 2,6-naphthalinedicarboxylic acid and 4,4'-biphenyldicarboxylic acid. Among them, terephtalic acid, isophtalic acid, and t-butylisopthalic acid, and alkyl esters thereof are preferable because these are easily available, and polymers which are easily emulsified are easily formed. The amount of copolymerization is preferably about 10 constituting mole %.

In this specification, "constituting mole %" is the percentage when the acid-derived constitutional component in all acid-derived constitutional components in a polyester, or the alcohol constitutional component in all alcohol-derived constitutional components in a polyester is taken as 1 unit (mole), respectively.

As the acid-derived constitutional component, in addition to the aforementioned aliphatic dicarboxylic acid (main component)-derived constitutional component and aromatic dicarboxylic acid (copolymerization component)-derived constitutional component, constitutional components such as a dicarboxylic acid-derived constitutional component having a double bond, and a dicarboxylic acid-derived constitutional component having a sulfonic acid component may be contained.

A dicarboxylic acid-derived constitutional component having a double bond includes a constitutional component derived from a lower alkyl ester or an acid anhydride of dicarboxylic acid having a double bond, in addition to a constitutional component derived from dicarboxylic acid having a double bond. The dicarboxylic acid-derived constitutional component having a sulfonic acid group includes a constitutional component derived from a lower alkyl ester or an acid anhydride of dicarboxylic acid having a sulfonic acid group, in addition to a constitutional component derived from dicarboxylic acid having a sulfonic acid group.

A dicarboxylic acid having double bonds can be suitably used, in order to prevent hot offset at fixing step, since the dicarboxylic acid is capable of crosslinking a resin as a whole utilizing the double bonds. Examples of such the dicarboxylic acid include fumaric acid, maleic acid, 3-hexenedioic acid, and 3-octenedioic acid, being not limiting. Additional examples include a lower alkyl ester, and an acid anhydride thereof. Among them, form a viewpoint of cost, fumaric acid and maleic acid are preferable.

A content of these dicarboxylic acid-derived constitutional components having double bonds in all acid-derived constitutional components is preferably 10 constituting mole % or less.

When the above mentioned content exceeds 10 constituting mole %, crystallizability of a polyester resin is reduced, and a melting point is depressed, and an image storability is deteriorated in some cases.

Dicarboxylic acid having a sulfonic acid group is effective since it can well disperse or emulsify a coloring material such as a pigment. When a whole resin is emulsified or suspended in water to prepare particles, if a sulfonic acid group is present, emulsification or suspension is possible without using a surfactant as described later. Examples of such the dicarboxylic acid having a sulfonic acid group include sodium 2-sulfoterepthalate, sodium 5-sulfoisophthalate, and sodium sulfosuccinate, which are not limited thereto. Additional examples include a lower alkyl ester, and an acid anhydride of them. Among them, from the viewpoint of cost, sodium 5-sulfoisophthalate is preferable.

When the dicarboxylic acid-derived constitutional component having a sulfonic acid group is contained in a polymer, the content of the dicarboxylic acid derived from constitutional component having a sulfonic acid group in all acid-derived constitutional components is preferably 5 constituting mole % or less and more preferably 3 constituting mole % or less.

When the content exceeds 5 construction mole %, the hydrophilicity of a polyester resin is increased, and the charging property of a toner under a highly humid condition is deteriorated.

-Alcohol-derived Constitutional Component-

As an alcohol which is to be an alcohol-derived constitutional component, an aliphatic diol is preferable, and a straight-chain type aliphatic diol having 7 to 20 carbon atoms is more preferable.

Since the crystallizability of a polyester resin decreases, and a melting point is lowered when the aliphatic diol is a branch type, the toner blocking resistance, image storability, and low-temperature fixability are deteriorated in some cases. When the chain carbon number is less than 7, in the case where the diol is polycondensed with aromatic dicarboxylic acid, the melting point becomes higher, and a low-temperature fixation becomes difficult in some cases. On the other hand, when the chain carbon number exceeds 20, the availability of the material becomes difficult practically. It is more preferable that the chain carbon number is 14 or less.

When polyester is obtained by polycondensing the diols with aromatic dicarboxylic acid, it is preferable that the chain carbon number is an odd. When the chain carbon number is an odd, the melting point of a polyester resin becomes lower than the case where the chain carbon number is an even, and the melting point is easily within a value in a numerical value range described later.

Examples of aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol, being not limiting. Among them, in view of easy availability, ethylene glycol, 1,4-butanediol, 1,6-hexanediol, 1,9-nonanediol, and 1,19-decanediol are preferable.

In an alcohol-derived constitutional component, a content of an aliphatic diol-derived constitutional component is 80 constituting mole % or more and, if necessary, other component may be contained. In an alcohol-derived constitutional component, it is more preferable that the content of an aliphatic diol-derived constitutional component is 90 constituting mole % or more.

When a content of an aliphatic diol-derived constitutional component is less than 80 constituting mole %, since the crystallizability of a polyester resin is reduced, and the melting point is lowered, the toner blocking resistance, image storability, and low-temperature fixability tend to be deteriorated.

Other optional components include constitutional components such as a diol-derived constitutional component having a double bond, and a diol-derived constitutional component having a sulfonic acid group. Examples of a diol having a double bond include 2-butene-1,4-diol, 3-hexene-1,6-diol, and 4-octene-1,8-diol.

A content of these diol-derived constitutional components having double bonds in all acid-derived constitutional components is preferably 20 constituting mole % or less, more preferably 2 to 10 constituting mole %. When the content exceeds 20 constituting mole %, the crystallizability of a polyester is deteriorated, the melting point is lowered, and the image storability are deteriorated in some cases.

Examples of a diol having a sulfonic acid group include 1,4-dihydroxy-2-sulfonic acid benzene sodium salt, 1,3-dihydroxymethyl-5-sulfonic acid benzene sodium salt, and 2-sulfo-1,4-butanediol sodium salt.

A content of these diol-derived constitutional components having a sulfonic acid group in all acid-derived constitutional components is preferably 5 constituting mole % or less.

When the content exceeds 5 constituting mole %, the hydrophilicity of a crystalline resin increases, and charging property of a toner under a high humid condition is deteriorated. It is not necessary to use as a copolymerization component, and it may be used in a amount minimum, if necessary, in order to assist in emulsifying a resin. Regarding the amount to be used, it is necessary to adjust to a minimum amount together with a dicarboxylic acid component having a sulfonic acid group.

When these alcohol-derived constitutional components other than an aliphatic diol-derived constitutional component (for example, a diol-derived constitutional component having double bonds and a diol-derived constitutional component having a sulfonic acid group) is added, the content of these alcohol-derived constitutional components is preferably in the range of 0 to 20 constituting mole %, more preferably in the range of 0 to 10 constituting mole %.

(Process for Producing Crystalline Polyester)

A process for producing a crystalline polyester resin is not particularly limited, but the resin can be prepared by a general polyester polymerization method in which an acid component is allowed to react with an alcohol component, and a resin is prepared by selectively using a direct polycondensation method, and a transesterification method, depending on kinds of monomers. A molar ratio (acid component/alcohol component) when an acid component is allowed to react with an alcohol component varies with reaction conditions or the like, and, therefore, it cannot be unconditionally determined, but usually around 1/1.

It is preferable that a crystalline polyester resin is prepared at a polymerization temperature of 180 to 230° C. and, if necessary, a reaction system is evacuated, and the reaction is performed while water and an alcohol produced during the condensation are removed. When a monomer is not dissolved or is not compatible under a reaction temperature, a high boiling point solvent is added as a solubilizing aid to dissolve the monomer. A polycondensation reaction is performed while the solulibilizing aid is distilled off. When a monomer having a low compatibility is present in a copolymerization reaction, the monomer having a low compatibility and an acid or an alcohol which is to be polycondensed with a monomer are previously condensed and, thereafter, a condensate may be polycondensed with a main component.

Examples of a catalyst which can be used for preparing crystalline polyester resins include an alkali metal compound such as sodium and lithium, an alkali earth metal compound such as magnesium and calcium, a metal compound such as zinc, manganese, antimony, titanium, zinc, zirconium and germanium, a phosphorous acid compound, a phosphoric acid compound and an amine compound, and specifically, the following compounds are exemplified.

Examples include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zilconyl acetate, zirconyl stearate, zirconyl octylate, germanium oxide, triphenyl phosphite, tris(2,4-di-t-butylphenyl)phosphite, ethyltriphenylphosphinium bromide, triethylamine and triphenylamine.

The melting point of the crystalline polyester thus obtained is preferably in the range of 60 to 120° C. and more preferably in the range of 70 to 100° C. A crystalline polyester having a melting point of lower than 60° C. tend to cause aggregation of the powder or deterioration of storability of a fixed image. On the other hand, when the melting point thereof exceeds 120° C., the low-temperature fixation may become difficult.

In the invention, the melting point of crystalline polyester was determined from the endothermic peak obtained when heated from room temperature to 150° C. at a programmed heating rate of 10° C. per minute in a differential scanning calorimeter (DSC). The resistance of the crystalline resin is preferably higher.

The ester concentration of the crystalline polyester represented by the following Formula 1 is preferably 0.01 or more and 0.15 or less, more preferably 0.05 or more and 0.12 or less, and particularly preferably 0.06 or more and 0.11 or less.

$$M=K/A \qquad \text{(Formula 1)}$$

(In Formula 1, M represents the ester concentration; K represents the number of ester groups in the resin; and A represents the number of atoms constituting the polymer chain).

A resin having an ester concentration of 0.01 or more is more compatible with amorphous resins, while a resin having an ester concentration of 0.15 or less has better electrostatic charging properties under a high humid condition.

The molecular weight of the high- or low-molecular weight polymer can be adjusted by controlling the reaction time. When the reaction time is shorter, the molecular weight of the polymer becomes lower. When the reaction time is longer, the molecular weight of the polymer becomes higher. In order to obtain a high-molecular weight polymer, the molar ratio of the total dicarboxylic acids to the total dialcohols is normally set to 1:1. In order to obtain a low-molecular weight polymer, the initial molar ratio of acids to alcohols is preferably set in the range of 95/100 to 100/95. It is preferable to add acids in excess to obtain a polymer having a higher acid value, while to add dialcohols in excess to obtain a polymer having a higher hydroxyl value.

As described above, the high- and the low-molecular weight polymers may be prepared respectively from different monomers, and examples of preferable combinations of monomers include a high-molecular weight polyester synthesized from dodecane dicarboxylic acid and 1,10-decanediol, and a low-molecular weight polyester synthesized from dodecane dicarboxylic acid and 1,4-butanediol; a high-molecular weight polyester synthesized from dodecane dicarboxylic acid and 1,10-decanediol and a low-molecular weight polyester synthesized from adipic acid and 1,4-butanediol; a high-molecular weight polyester synthesized from dodecane dicarboxylic acid and 1,9-nonanediol and a low-molecular weight polyester synthesized from sebacic acid and 1,6-hexanediol; and the like.

<Amorphous Resin>

The amorphous resin, which constitutes the binder resin with the crystalline resin, is preferably contained in the binder resin components in an amount of the range of 65 to 95% by weight. Any amorphous resins conventionally used as a toner component may be used, and examples thereof include, but are not limited to, polystyrene, styrene/butadiene polymers, styrene/acrylic polymers, polyester, and the like. These amorphous resins may be further modified with urethane, urea, epoxy, or the like. Combination of a crystalline polyester with an amorphous polyester is preferable, from the viewpoint of compatibility.

Other monomers for use in the amorphous polyester include the monomer components described, for example, in "Polymer Data Handbook -Basic-" (Soc. Polymer Science, Japan Ed., Baihukan), i.e., known bivalent, trivalent or polyvalent carboxylic acids and bivalent, trivalent or polyvalent alcohols. Typical examples of the bivalent carboxylic acids, among the monomer components above, include dibasic acids such as succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexanedicarboxylic acid, malonic acid, metaconic acid, and dodecenylsuccinic acid, and the anhydrides and lower alkyl esters thereof; aliphatic unsaturated dicarboxylic acids such as maleic acid, fumaric acid, itaconic acid, and citraconic acid; and the like. Typical examples of the trivalent or higher carboxylic acids include 1,2,4-benzenetricarboxylic acid, 1,2,5-benzenetricarboxylic acid, and 1,2,4-naphthalenetricarboxylic acid, and the anhydrides and lower alkyl esters thereof, and the like. These acids may be used alone or in combination of two or more.

Examples of the bivalent alcohols include bisphenol A, hydrogenated bisphenol A, bisphenol A/ethylene oxide and/or propylene oxide adducts, 1,4-cyclohexanediol, 1,4-cyclohexanedimethanol, ethylene glycol, diethylene glycol, propylene glycol, dipropylene glycol, 1,3-butanediol, 1,4-butanediol, 1,5-pentanediol, 1,6-hexanediol, 1,9-nonanediol, neopentylglycol, and the like. Examples of the trivalent or higher alcohols include glycerol, trimethylolethane, trimethylolpropane, pentaerythritol, and the like. These alcohols may be used alone or in combination of two or more. A monovalent acid such as acetic acid or benzoic acid, or a monovalent alcohol such as cyclohexanol or benzylalcohol may be used as needed, for controlling the acid or hydroxyl value.

The amorphous polyester can be prepared from the monomer components described above in any combination, according to the known methods, for example, described in "Polycondensation" (Kagaku-dojin Publishing Company), "Experiments in Polymer Science, Polycondensation and Polyaddition" (Kyoritsu Shuppan Co., Ltd.), "Polyester Handbook" (Nikkankogyo Shimbun Ed.,), or the like; and it may be prepared, for example, by an ester exchange method, a direct polycondensation method, or the like, or by a method in combination thereof. When the amorphous polyesters are used, the amorphous polyester preferably has a weight-average molecular weight Mw in the range of 5,000 to 40,000 and a number-average molecular weight Mn in the range of 2,000 to 10,000. The weight-average molecular weight Mw is more preferably in the range of 8,000 to 15,000 and the number-average molecular weight Mn in the range of 3,500 to 8,000, from the viewpoint of the low-temperature fixation.

The glass transition temperature of the amorphous polyester is preferably in the range of 30 to 80° C. A glass transition temperature lower than the range above may result in deterioration of a at resistance blocking property, while a ass transition temperature higher than the range above may cause an increase in the minimum fixing temperature. The glass transition temperature Tg can be determined, for example, by using a differential scanning calorimeter (DSC3110, manufactured by MacScience, thermal analysis system 001) under the condition of a programmed heating rate of 5° C./minute, and corresponds to the temperature of a shoulder at the lower temperature side of the endothermic point of Tg in the chart obtained.

Hereinafter, preferable examples of the styrene resins will be described. Among the monomers for the styrene resin, (meth)acrylic resin and a copolymer resin thereof, examples of the monomers for the styrene resin include styrene; alkyl-substituted styrenes having an alkyl chain such as α-methylstyrene, vinylnaphthalene, 2-methylstyrene, 3-methylstyrene, 4-methylstyrene, 2-ethylstyrene, 3-ethylstyrene, and 4-ethylstyrene; halogen-substituted styrenes such as 2-chlorostyrene, 3-chlorostyrene, and 4-chlorostyrene; fluorine-substituted styrenes such as 4-fluorostyrene, and 2,5-difluorostyrene; and the like. Examples of the monomers for the (meth)acrylic acid resin include (meth)acrylic acid, methyl (meth)acrylate, ethyl (meth)acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth) acrylate, isobutyl (meth)acrylate, t-butyl (meth)acrylate, isopentyl (meth)acrylate, amyl (meth)acrylate, neopentyl (meth)acrylate, isohexyl (meth)acrylate, isoheptyl (meth) acrylate, isooctyl (meth)acrylate, 2-ethylhexyl (meth)acrylate, phenyl (meth)acrylate, biphenyl (meth)acrylate, diphenylethyl (meth)acrylate, t-butylphenyl (meth)acrylate, terphenyl (meth)acrylate, cyclohexyl (meth)acrylate, t-butylcyclohexyl (meth)acrylate, diethylaminoethyl (meth)acrylate, diethylaminoethyl (meth)acrylate, methoxyethyl (meth) acrylate, 2-hydroxyethyl (meth)acrylate, β-carboxyethyl (meth)acrylate, (meth)acrylonitrile, (meth)acrylamide, and the like. The styrene resin can be prepared from any combination of these monomers properly selected, according to a known method.

When the styrene resin, (meth)acrylic resin or a copolymer resin thereof is used, a resin having a weight-average molecular weight Mw in the range of 20,000 to 100,000 and a number-average molecular weight Mn in the range of 2,000 to 30,000 are preferably used. The molecular weight of amorphous resin can be determined in a similar manner to that of crystalline resin.

The content of the binder resin containing both of the crystalline and amorphous resins in the electrophotographic toner according to the invention is preferably 70 to 95% by weight and more preferably 80 to 90% by weight.

<Coloring Agent>

A coloring agent in the toner for electrophotography of the invention is not particularly limited, but examples include the known coloring agents, and a coloring agent can be appropriately selected depending on the purpose. A coloring agent may be used alone, or two or more kinds of the same series of coloring agents may be used in combination. Alternatively, two or more different kinds of coloring agents may be used in combination. These coloring agents may be surface-treated.

Various pigments or dyes are used as coloring agents. Specific examples of the coloring agent include carbon black, copper oxide, manganese dioxide, aniline black; active carbon non-magnetic ferrite and magnetite, as black pigments. Yellow pigments include chrome yellow, zinc yellow, yellow ion oxide, cadmium yellow, chrome yellow, hanza yellow, benzidine yellow, benzidine yellow GR, threne yellow, quinoline yellow and permanent yellow NCG.

Examples of orange pigments include red chrome yellow, molybdenum orange, Permanent Orange GTR, pyrazolone orange, Vulcan Orange, Benzidine Orange G, Indanthren Brilliant Orange RK, Indanthren Brilliant Orange GK, and the like.

Examples of red pigments include Bengala, cadmium red, red lead, mercury sulfide, Watchung Red, Permanent Red 4R, Lithol Red, Brilliant Carmine 3B, Brilliant Carmine 6B, pyrazolone red, rhodamine lake B, Lake Red C, rose bengal, eosin red, alizarin lake, and the like.

Examples of blue pigments include iron blue, cobalt blue, alkali blue lake, Victoria blue lake, Fast Sky Blue, Indanthren Blue BC, ultramarine blue, phthalocyanine blue, phthalocyanine green, and the like. Examples of violet pigments include manganese purple, Fast Violet B, methyl violet lake, and the like.

Examples of green pigments include chromium oxide, chromium green, Pigment Green B, malachite green lake, Final Yellow Green G, and the like. Examples of white pigments include zinc white, titanium oxide, antimony white, zinc sulfide, and the like. Examples of extender pigments include barytes, barium carbonate, clay, silica, white carbon, talc, alumina white, and the like.

Examples of dyes include various dyes such as basic, acidic, dispersion, and direct dyes, and specific examples thereof include nigrosine, methylene blue, rose bengal, quinoline yellow, and the like.

It is possible to prepare a coloring agent particle dispersion with these coloring agents, for example, by using a rotary shearing homogenizer, a medium-dispersing machine such as a ball mill, sand mill or attriter, a high-pressure countercollision dispersing machine, or the like. These coloring agents may also be dispersed in an aqueous system in a homogenizer, by using a polar surfactant.

The coloring agents for use in the toner according to the invention are selected from the viewpoints of the hue angle, saturation, lightness, weather resistance, light fastness, OHP transmittance, and dispersability in toner. For ensuring color forming property during fixation, the coloring agent is preferably added in an amount in the range of 4 to 15% by weight, more preferably 4 to 10% by weight, with respect to the total weight of the solid matters in toner. However, when a magnetic substance is used as the black coloring agent, the magnetic substance is preferably added in an amount in the range of 12 to 48% by weight and more preferably in the range of 15 to 40% by weight.

The average diameter (median diameter) of the coloring agent particles contained in the toner is preferably in the range of 100 to 330 nm and more preferably in the range of 100 to 200 nm. It is possible to ensure the transparency and color forming property of the image formed on an OHP sheet, by adjusting the average diameter (median diameter) of the coloring agent particles in the range above. The average diameter of coloring agent particles is determined, for example, by using a laser-diffraction particle size distribution analyzer (LA-700, manufactured by Horiba, Ltd.).

Color toners such as yellow toner, magenta toner, cyan toner, black toner, and the like can be obtained respectively, by properly selecting the kinds of the coloring agents in the above.

A releasing agent is generally used for the purpose of improving relesability. Examples of a releasing agent include low-molecular polyolefins such as polyethylene, polypropylene and polybutene; silicones having a softening point by heating; aliphatic amines such as oleic acid amide, erucic acid amide, ricinolic acid amide, and stearic acid amide; vegetable waxes such as carnauba wax, rice wax, candelilla wax, Japan wax, and jojoba oil; animal waxes such as beewax; mineral and petroleum waxes such as montan wax, ozokerite, seresin, paraffin wax, microcrystalline wax, and Fischer-Tropsch wax; ester waxes such as fatty acid ester, montanoic acid ester, and carboxylic acid ester. In the invention, these releasing agents may be used alone, or two or more kinds may be used jointly.

It is possible to obtain a releasing agent dispersion by dispersing it in water with an ionic surfactant or a polyelectrolyte such as polymer acid or polymer base, heating the dispersion to a temperature higher than the melting point of the releasing agents under a high shearing force, and dispersing it in a homogenizer or a high-pressure ejecting dispersing machine (Gaulin homogenizer, manufactured by APV Gaulin) until the diameter of the particles therein becomes 1 μm or less. The diameter of the particles in the releasing agent particle dispersion can be determined, for example, by using a laser-diffraction particle diameter distribution analyzer (LA-700, manufactured by Horiba, Ltd.).

An addition amount of these releasing agents is preferably in a range of 0.5 to 50% by weight, more preferably in a range of 1 to 30% by weight, further preferably in a range of 5 to 15% by weight relative to a total amount of a toner. When the addition amount is less than 0.5% by weight, there may not be the effect of addition of a releasing agent and, when the addition amount exceeds 50% by weight, adverse effects on charging property or powder fluidity easily occur, and a toner may easily be destructed in a developing machine, adhesion of a releasing agent onto a carrier may occur, and influence such as easy reduction in charging may arise, for example, when an OHP image is fixed, bleeding onto a image surface may become insufficient, and a releasing agent tends to remain in an image, resulting in reduction of transparency. This is not preferable.

<Other Components>

Other components which can be used in a toner for electrophotography of the invention are not particularly limited, but can be appropriately selected depending on the purpose, and examples include the known various additives such as inorganic particles, organic particles, charge controlling agents, and releasing agents.

The inorganic particles are generally used for the purpose of improving flowability of a toner. Examples of the inorganic particles include particles such as silica, alumina, titanium oxide, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, zirconium oxide, silicon carbide, and silicon nitride. Among them, silica particles are preferable, and hydrophobicized silica particles are particularly preferable.

An average primary particle diameter (number average particle diameter) of an inorganic particle is preferably in the range of 1 to 1,000 nm, and an addition amount (external addition) of the particles is preferably in the range of 0.01 to 20 parts by weight relative to 100 parts by weight of a toner.

Organic particles are generally used for the purpose of improving the cleaning property and transferability and, occasionally, charging property. Examples of the organic particles include particles of polystyrene, polymethyl methacrylate, polyfluorinated vinylidene, and styrene-acryl copolymer.

A charge controlling agent is generally used for the purpose of improving the charging property. Examples of the charge controlling agent include a salicylic acid metal salt, metal-containing azo compound, nigrosine and a quaternary ammonium salt.

<Core Shell Structure>

The electrophotographic toner according to the invention may be covered with a surface layer, i.e., a shell region (shell layer), on the surface. The surface layer preferably does not have significant influences on the mechanical and melt viscoelasticity of the entire toner. The surface layer is, for example, a resin-coated layer, a particle-coated layer, or a chemically finished coat layer. When a crystalline substance is exposed outside from the toner surface, external additives may be embedded in the crystalline area, and quality control may become difficult. If a toner is covered with a thick surface layer, a crystalline shell may not fully exert its effect on the low-temperature fixation. Thus, the thickness of the surface layer is preferably thinner, and specifically, is preferably in the range of 0.05 to 0.5 μm when a resin-coated layer is used. If it is a particle-coated layer, the particles preferably have a diameter of 0.5 μm or less.

In order to form a thin surface layer having a thickness in the range above, particles containing a binder resin, a coloring agent, inorganic particle added, if necessary, and others are deposited or adsorbed on the surface of the toner to cover the toner, and additionally the resultant particles are smoothed, if necessary. Alternatively, the thin surface layer is preferably formed by resin coating a resin by adsorbing and graft-polymerizing or interfacial polymerizing a monomer, or by chemical treatment.

The component used for forming the surface layer is, for example, a silane coupling agent, isocyanates or vinyl monomer, a resin, and the particles thereof, or the like.

The toner surface is preferably treated directly with a silane coupling agent, for forming its layer. The isocyanates are preferably polymerized with a diamine or dialcohol contained in the resin at the interface of the toner. Alternatively, the surface layer may be prepared by modifying polyester terminals with isocyanate and converting the modified group into urea in water.

The methods of the chemical treating vinyl monomer include, for example, oxidizing methods using a strong oxidizing agent such as peroxide, or ozone oxidation, or plasma oxidation, graft or seeding polymerization with a polymerizable monomer containing a polar group, and the like.

In the invention, the surface layer is preferably formed by an emulsification/aggregation/coalescence method. The material for the surface layer is preferably an amorphous resin, and selected from the materials similar to the amorphous resins (amorphous resins in the section <binder resin>, etc. described in the above) for the core region. The materials and the material composition of the surface layer may be the same as or different from those of the core region, but is preferably different (namely, different monomers are used), because the crystalline resin is preferably localized in the core region. If they are different from each other and if the difference in SP values between the material in surface layer and the amorphous resin in core region is too large, it is difficult to form the surface layer, and thus, the difference in SP values is preferably 0.5 or less. In addition, the molecular weights and the glass transition points thereof are favorably similar to each other.

The SP value of a resin is calculated by using the Fedors' parameters shown in the following Formula 1. The SP value can be calculated from the monomer composition according to the following Formula.

$$SP \text{ value} = \sqrt{(Ev/v)} = \sqrt{(\Sigma\Delta ei/\Sigma\Delta vi)} \quad \text{(Formula 1)}$$

wherein, Ev represents the energy of vaporization (cal/mol) and v represents the molar volume ($cm^3$/mol); and, Δei represents the energy of vaporization of each atom or atomic group and Δvi represents the molar volume of each atom or atomic group.

If a surface layer is formed by depositing the substance above on the toner particle surface chemically or physically, it is also possible, for example, to coat the outer surface of the toner mother particles mechanically with resin particles, and such a method is preferable for controlling the electrostatic charging properties of the toner mother particles. Examples of the resin particles include particles of styrene resins, styrene-acryl copolymers, polyester, and the like. Mixers for use in coating include sample mill, Henschel mill, V blender, hybridizer, and the like.

In addition, various particles such as metal, metal oxide, metal salt, ceramic, resin, and carbon black particles may be added for improvement on the charging property, conductivity, powder flowability, lubricity, and others.

<Method of Producing Toner>

Hereinafter, the method of producing the electrophotographic toner according to the invention will be described.

The method of producing the toner according to the invention is not particularly limited, but wet processes of preparing toner particles in water, such as an aggregation/coalescence method, suspension polymerization method and dissolution/suspension method, are preferred, because the shape is controlled by these methods so that the toner becomes more resistant to breakdown in a developing device. In particular, the aggregation/coalescence method, by which the shape is easily controlled and a resin-coated layer is formed easily, is preferable.

The aggregation/coalescence method is a manufacturing process, comprising a mixing step of mixing a resin particle dispersion containing resin particles, a coloring agent particle dispersion containing coloring agent particles, and a releasing agent particle dispersion containing releasing agent particles; an aggregation step of forming an aggregate particle dispersion containing the aggregate particles of the resin particles, the coloring agent particles, and the releasing agent particles; and a coalescence step of coalescing the aggregate particles by heating the dispersion to a temperature of not lower than the glass transition point of the resin particles.

Specifically, a toner is prepared by preparing a resin particle dispersion containing an ionic surfactant generally by emulsion polymerization or the like, mixing a coloring agent particle dispersion and a releasing agent particle dispersion, forming aggregate particles having the toner diameter by heteroaggregation with a coagulant having a polarity opposite to the ionic surfactant, coalescing the aggregate particles by heating the dispersion to a temperature of not lower than the glass transition point of the resin particles, and washing and drying the resulting particles.

The resin particle dispersion in the mixing step is generally prepared by mixing a crystalline resin dispersion and an amorphous resin dispersion separately prepared. In the invention, the crystalline resin dispersion may be prepared by mixing dispersions of the high-molecular weight crystalline resin particles and low-molecular weight crystalline resin particles separately prepared, or alternatively, by preparing a dispersion containing both high- and low-molecular weight crystalline resin particles. The latter method provides a toner having a superior low-temperature fixing property.

In an early phase of the aggregation step of mixing the crystalline and amorphous resin particle dispersions, the coloring agent particle dispersions and the releasing agent particle dispersion, it is also possible to differentiate the amounts of ionic dispersants having different polarities intentionally; neutralize the dispersion ionically by adding an inorganic metal salt polymer such as polyaluminum chloride; form and stabilize the first-phase mother aggregate particles by heating the dispersion to a temperature of not lower than glass transition point; and add a particles dispersion containing an ionic dispersant having the polarity and in the amount correcting the ionic imbalance additionally in the second phase, and, as needed, fuse and stabilize the resin particles in aggregate particles and the resin particles added additionally by heating them to a temperature of not higher than the glass transition point of the resin; and fuse and deposit the particles added in the second phase of forming aggregate on the surface of the mother aggregate particles by heating to a temperature of not lower than the glass transition point or more. In addition, the stepwise operations of aggregation may be repeated multiple times. The resin particles added additionally may be different from the particles used during aggregation. Use of the two-step method give a core shell structure having a surface layer in which the crystalline resin, releasing agent, and coloring agent are contained in the core more tightly.

In particular, when a vinyl monomer is used for the amorphous resin particles, it is possible to prepare the resin particle dispersion in emulsion polymerization, for example, by using an ionic surfactant. Alternatively when an other resin is used, it is possible to prepare the resin particle dispersion by dissolving the resin in an oily solvent if soluble relatively lower in solubility in water, and dispersing the solution in water together with an ionic surfactant or a polyelectrolyte forming particles in a dispersing machine such as a homogenizer, or dispersing the solution in water by phase-inversion emulsification and then removing the solvent by heating or under reduced pressure.

The crystalline resin may be dissolved or dispersed in the resin particle dispersion or mixed with the releasing agent particle dispersion during its preparation. In this manner, it is possible to blend the crystalline resin in toner.

It is possible to improve the separability of the image fixed in the oilless fusion method, by dispersing a releasing agent as particles, for example, having a volume-average diameter in the range of 150 to 1,500 nm in the electrophotographic toner in an amount in the range of 5 to 25% by weight. More preferred ranges of the volume-average diameter and the addition amount thereof are respectively 160 to 1,400 nm and 1 to 20% by weight.

It is possible to prepare a dispersion containing releasing agent particles having a diameter of 1 μm or less, by dispersing the releasing agent in water with an ionic surfactant or an polyelectrolyte such as polymer acid or polymer base and pulverizing the releasing agent into particles by applying a strong shearing force by using a homogenizer or a high-pressure ejecting dispersing machine while heating the dispersion to a temperature of not lower than the melting point.

The concentration of the surfactant for use in the releasing-agent dispersion is preferably 4% by weight or less with respect to the releasing agent. A concentration of 4% by weight or more leads to decrease in the aggregation speed of the particles formed and elongation of the heating time, and thus is not preferred.

In addition, the toner become superior in a color-forming property as well as an OHP transmittance, by dispersing a coloring agent as particles having a volume-average diameter in the range of 100 to 330 nm in the electrophotographic toner in an amount in the range of 4 to 15% by weight. The volume-average diameter is favorably in the range of 120 to 310 nm and the preferable addition amount is in the range of 5 to 14% by weight.

The coloring agent is dispersed by a known method, and preferable examples of the dispersing machines include medium-dispersing machines such as rotary shearing homogenizer, ball mill, sand mill, attriter, and coball mill; roll mills such as three-roll mill; cavitation mills such as nanomizer; colloid mill, high-pressure countercollision dispersing machine, and the like.

In the method of producing a toner according to the invention, examples of the surfactants for use in emulsion polymerization of binder resin particles, a dispersion of coloring agent, a dispersion of resin particles, a dispersion of releasing agent, or aggregation or stabilization thereof include anionic surfactants such as sulfate ester salts, sulfonate salts, phosphate esters, and soaps; cationic surfactants such as amine salts and quaternary ammonium salts; and the like. In addition, combined use of a nonionic surfactant such as polyethylene glycol, an alkylphenol ethylene oxide adduct, or a polyvalent alcohol is also effective. Common mixers including rotary shearing homogenizers and medium-containing mills such as ball mill, sand mill, and Dynomill can be used as the means for dispersion.

When coloring agent particles coated with polar resin particles are used, it is possible to use a method of dissolving or dispersing the resin and the coloring agent in a solvent (water, surfactant, alcohol, or the like) and dispersing the mixture in water together with a suitable dispersant described above (containing an activator), and removing the solvent under heat or reduced pressure, or a method of fixing coloring agent particles on the surface of the resin particles prepared by emulsion polymerization by applying a mechanical shearing force or electrical attractive force. These methods are effective for preventing release of the coloring agent added to the aggregate particles and improving the dependency of its charging property on the coloring agent.

After the coalescence step, desired toner particles are processed as needed in the washing, solid-liquid separation, and drying steps; and the particles are preferably washed thoroughly with ion-exchange water in the cleaning step for generation and preservation of preferable electrostatic charging properties. The solid-liquid separation step is not particularly limited, but from the point of productivity, for example, a suction filtration or pressurizing filtration, centrifugal filtration, and decanter preferably are used. The drying step is also not particularly limited, but from the point of productivity, driers favorably used include an air dryer, spray dryer, rotary dryer, air-flow dryer, fluidized-bed dryer, heat-transfer-heating dryer, freeze dryer, and the like.

In a similar manner to common toner production processes, it is also possible to add inorganic particles formed of a metal salt such as calcium carbonate, a metal oxide compound such as silica, alumina, titania, barium titanate, strontium titanate, calcium titanate, cerium oxide, zirconium oxide, or magnesium oxide, ceramic, or carbon black, or resin particles formed of a vinyl resin, polyester, or silicone, onto the toner surface in the dry state by applying a shearing force, for improvement in flowability and cleaning efficiency.

These inorganic particles are preferably surface-finished, for example, with a coupling agent, for control of conductivity, electrostatic charging property, and the like; and typical examples of the coupling agents include silane coupling agents such as methyltrichlorosilane, methyldichlorosilane, dimethyldichlorosilane, trimethylchlorosilane, phenyltrichlorosilane, diphenyldichlorosilane, tetramethoxysilane, methyltrimethoxylsilane, dimethyldimethoxysilane, phenyltrimethoxylsilane, diphenyldimethoxysilane, tetraethoxysilane, methyltriethoxysilane, dimethyldiethoxysilane, phenyltriethoxysilane, diphenyldiethoxysilane, isobutyltrimethoxylsilane, decyltrimethoxylsilane, hexamethylsilazane, N,N-(bistrimethylsilyl) acetamide, N,N-bis (trimethylsilyl)urea, tert-butyldimethylchlorosilane, vinyltrichlorosilane, vinyltrimethoxylsilane, vinyltriethoxysilane, γ-methacryloxypropyltrimethoxylsilane, β-(3,4 epoxycyclohexyl)ethyltrimethoxylsilane, γ-glycidoxypropyltrimethoxylsilane, γ-glycidoxypropylmethyldiethoxysilane, γ-mercaptopropyltrimethoxylsilane, and γ-chloropropyltrimethoxylsilane; titanium coupling agents; and the like.

The particles may be adhered onto the surface of the toner after the toner is dried, by using a mixer such as V blender or Henschel Mixer by a dry system, or after dispersing the particles in an aqueous liquid such as water or water/alcohol, the dispersion is added to the toner in a slurry state, and the mixture is dried to adhere the external additive onto the toner surface. Alternatively, a slurry may be dried during spraying the slurry onto a dry powder.

For confirming that the electrophotographic toner obtained in this manner contains crystalline resins respectively having weight-average molecular weights in the range of 15,000 to 40,000 and in the range of 2,000 to 10,000, for example, the molecular weights of the crystalline resin and the amorphous resin in toner are determined by the GPC as described above after they are separated. For separation of the resins, for example, the crystalline resin is separated by dispersing or dissolving the amorphous resin in a solvent such as ethyl acetate or toluene.

<Developer>

Hereinafter, the developer according to the invention will be described. The developer according to the invention is not particularly limited, if it contains the toner according to the invention, and may have any composition, depending on its applications. The developer according to the invention is a one-component developer when the toner is used alone or a two-component developer when the toner is used in combination with a carrier.

The carrier is not particularly limited, and may be any one of known carriers, and examples thereof include known carriers such as resin-coated carriers described, for example, in JP-A Nos. 62-39879 and 56-11461, and others.

Typical examples of the carriers include the following resin-coated carriers. Core particles for the carrier include iron powder, ferrite particles, and the like commonly used; and the average particle diameter thereof is preferably in the range of about 30 to about 200 μm.

Examples of the coating resins for the resin-coated carrier include homopolymers or copolymers of two or more monomers, for example, of styrenes such as styrene, p-chlorostyrene, and α-methylstyrene; α-methylene fatty monocarboxylic esters such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acrylic compounds such as dimethylaminoethyl methacrylate; vinylnitriles such as acrylonitrile and methacrylonitrile; vinylpyridines such as 2-vinylpyridine and 4-vinylpyridine; vinylethers such as vinylmethylether and vinylisobutylether; vinylketones such as vinylmethylketone, vinylethylketone, and vinyl isopropenylketone; olefins such as ethylene, propylene and the like; copolymers of vinyl fluorine-containing monomers such as vinylidene fluoride, tetrafluoroethylene, and hexafluoroethylene; silicone resins such as methylsilicone and methylphenylsilicone; bisphenol, polyesters containing glycol or the like, epoxy resins, polyurethane resins, polyamide resins, cellulosic resins, polyether resins, polycarbonate resin, and the like. These resins may be used alone or in combination of two or more. The coating amount of the coated resin is preferably in the range of approximately 0.1 to 10 parts by weight and more preferably in the range of 0.5 to 3.0 parts by weight with respect to 100 parts by weight of the core particles.

A heating kneader, a heating type Henschel mixer, UM mixer, or the like may be used for production of the carriers, and a heated fluidized bed, heated kiln, or the like may also be used, depending on the amount of the coating resins.

The blending ratio of the toner to the carrier in the developer according to the invention is not particularly limited, and may be decided suitably according to applications.

<Image-forming Process>

Hereinafter, the image-forming process according to the invention will be described. The image-forming process according to the invention is an image-forming process comprising a latent image-forming step of forming an electrostatic latent image on a latent image carrier surface, a developing step of developing the electrostatic latent image formed on the latent image carrier surface with a developer held on a developer carrier to form a toner image, a transferring step of transferring the toner image formed on the latent image carrier surface onto the surface of an image-receiving member, and a fixing step of thermally fusing the toner image transferred on the image-receiving member surface, wherein a developer containing the electrophotographic toner according to the invention is used as the developer. The developer may be a one-component or two-component developer.

Any known steps in the image-forming process may be used as each step above. For example, an electrophotographic photosensitive body or a dielectric recording body may be used as the latent image carrier. In the case of electrophotographic photosensitive body, an electrostatic latent image is formed on the surface of the electrophotographic photosensitive body by electrostatically charging the surface of image-forming layer uniformly with a corotron charger, a contact charger, or the like, and irradiating thereof with light (latent image forming step), then, forming a toner image on the electrophotographic photosensitive body by adhering toner particles to the electrostatic latent image while bringing a developing roll having a developer layer formed on the surface into contact with or close proximity to the image (developing process), transferring the formed toner image onto the surface of an image-receiving member such as paper by using, for example, a corotron charger (transferring process), and fusing the toner image transferred onto the image-receiving member surface in the fixing unit.

Normally, a releasing agent is supplied to the fixing member in the fixing unit during heat fixation in the fixing unit, for prevention of offsetting or the like.

The method of supplying the releasing agent onto the surface of a roller or belt, which is a fixing member used for thermal fusion, is not particularly limited, and examples thereof include a pad method of using a pad impregnated with a liquid releasing agent, a web method, a roller method, a non-contact shower method (spray method), and the like; and among them, a web method and roller method are preferable. These methods, which supply the releasing agent uniformly and allow to control the feed rate, are advantageous. It is necessary to use a blade or the like additionally, to supply the releasing agent uniformly to the entire fixing member by the shower method.

Examples of the image-receiving members (recording media), to which the toner image is transferred, include plain paper and OHP sheets used in copying machines, printers and others in the electrophotographic process, and the like.

EXAMPLES

Hereinafter, the present invention will be described in detail with reference to Examples, but it should be understood that the invention is not restricted thereby. The "part" and "%" in the Examples below mean respectively "part by weight" and "% by weight", unless otherwise specified.

-Methods of Measuring Particle Size and Particle Size Distribution-

In the following Examples and Comparative Examples, the particle diameter (or particle size) and particle diameter distribution are determined by the following means.

When the particle diameter measured is 2 μm or more, the apparatus used is Coulter Counter TA-II (manufactured by Beckmann Coulter) and the electrolyte solution used is ISOTON-II (manufactured by Beckmann Coulter).

In measurement, 10 mg of test sample is added to 2 ml of 5% aqueous solution containing a surfactant (sodium alkylbenzenesulfonate) as a dispersant. The mixture is added to 100 ml of the electrolyte solution above. The test sample-suspended electrolyte is dispersed in an ultrasonic homogenizer for about 1 minute; and the volume- and number-average distributions of the particles are determined by analyzing particles of 2.0 to 60 μm in diameter by using the Coulter Counter type TA-II and an aperture having a diameter of 100 μm. The number of particles measured is 50,000.

The particle diameter distribution of toner is determined as follows: A cumulative distribution curve is drawn from the smallest diameter by plotting the volume-average number in each divided particle diameter range (channel) from the measured particle diameter distribution, and the cumulative volumetric particle diameter at cumulative 16% is defined as D16v, the cumulative volumetric particle diameter at cumulative 50% as D50v, and the cumulative volumetric particle diameter at cumulative 84% as D84v. The volume-average diameter is the D50v, and the lower-diameter volume-average diameter indicator GSDv is calculated according to the following Formula:

Formula: $GSDv=\{(D84v)/(D16v)\}^{0.5}$

When the diameter of the particles measured is less than 2 μm, the apparatus used is, for example, a laser-diffraction particle diameter distribution analyzer (LA-700: manufactured by Horiba, Ltd.). In measurement, a dispersion containing a sample in an amount of approximately 2 g as solid matter is prepared and diluted with ion-exchange water to make a total volume of approximately 40 ml. The dispersion is placed in a cell and left for approximately two minutes, and measured after the concentration in the cell becomes uniform. The diameter obtained in each channel was cumulated from the smaller volume-average diameter, and the diameter at cumulative 50% is defined as the volume-average diameter.

-Method of Measuring the Molecular Weight and Molecular-weight Distribution of Toner and Resin Particles- The molecular weight and molecular-weight distribution are determined as follows: The gel permeation chromatography (GPC) system used is "HLC-8120GPC, SC-8020 (manufactured by Tosoh Corporation), and the columns used are two "TSK gel, Super HM-H columns (manufactured by Tosoh Corporation, 6.0 mm ID×15 cm)", and the eluant is THF(tetrahydrofuran). The measuring conditions are: sample concentration: 0.5%, flow rate: 0.6 ml/min, sample injection: 10 μl, and measurement temperature: 40° C.; and detector: IR detector. The calibration curve is prepared by using 10 polystyrene TSK standard samples manufactured by Tosoh Corporation: A-500, F-1, F-10, F-80, F-380, A-2500, F-4, F-40, F-128, and F-700.

-Methods of Measuring Melting Point and Glass Transition Temperature-

The melting point and the glass transition temperature of toner are determined from the maximum peak obtained by measurement according to the method of ASTM D3418-8, by using a DSC (differential scanning calorimeter).

The main maximum peak is determined by using DSC-7 manufactured by Perkin Elmer, by using the melting points of indium and zinc for temperature correction and the fusion heat of indium for calorimetric correction of the detector. The measurement is performed by heating a sample on an aluminum pan together with an empty pan as the reference at a programmed heating rate of 10° C./min.

<Crystalline Resin (1) and its Emulsion>

A mixture of 600 parts of dodecanedicarboxylic acid, 454 parts of 1,10-decanediol, and 0.43 part of dibutyltin oxide are stirred under nitrogen atmosphere at 180° C. for 6 hours. The mixture is then stirred under reduced pressure for 20 minutes, to give a crystalline resin (1) having a weight-average molecular weight Mw of 4,900 and a number-average molecular weight Mn of 2,300.

Then, 50 parts of the crystalline resin (1) is dissolved in 250 parts of ethyl acetate; a solution containing 2 parts of an anionic surfactant DOW-FAX in 300 parts of ion-exchange water is added thereto; the mixture is stirred in Ultra-Turrax at a frequency of 8,000 revolutions for 10 minutes; and removal of ethyl acetate gives a crystalline resin latex (1) containing particles having a volume-average particle diameter of 0.17 μm.

<Crystalline Resin (2) and its Emulsion>

A mixture of 600 parts of dodecanedicarboxylic acid, 454 parts of 1,10-decanediol, and 0.43 part of dibutyltin oxide is stirred under nitrogen atmosphere at 180° C. for 6 hours. Then, the mixture is gradually heated to 200° C. under gradually decreasing pressure and stirred for 6 hours, to give a crystalline resin (2) having a weight-average molecular weight Mw of 26,600 and a number-average molecular weight Mn of 11,200.

Then, 50 parts of the crystalline resin (2) is dissolved in 250 parts of ethyl acetate; a solution containing 2 parts of an anionic surfactant DOW-FAX in 300 parts of ion-exchange water is added thereto; the mixture is stirred in Ultra-Turrax at a frequency of 8,000 revolutions for 10 minutes; and removal of ethyl acetate gives a crystalline resin latex (2) having a volume-average particle diameter of 0.20 μm.

<Crystalline Resin (3) and its Emulsion>

A mixture of 700 parts of dodecanedicarboxylic acid, 281 parts of 1,4-butanediol, and 0.38 part of dibutyltin oxide is stirred under nitrogen atmosphere at 180° C. for 6 hours. Then, the mixture is stirred under reduced pressure for 20 minutes, to give a crystalline resin (3) having a weight-average molecular weight Mw of 5,000 and a number-average molecular weight Mn of 2,500.

Then, 50 parts of the crystalline resin (3) is dissolved in 250 parts of ethyl acetate; a solution containing 2 parts of an anionic surfactant DOW-FAX in 300 parts of ion-exchange water is added thereto; the mixture is stirred in Ultra-Turrax at a frequency of 8,000 revolutions for 10 minutes; and removal of ethyl acetate gives a crystalline resin latex (3) having a volume-average particle diameter of 0.12 μm.

<Crystalline Resin (4) and its Emulsion>

A mixture of 1,500 parts of adipic acid, 920 parts of 1,4-butanediol, and 0.38 part of dibutyltin oxide is stirred under nitrogen atmosphere at 180° C. for 6 hours. The, the mixture is stirred under reduced pressure for 20 minutes, to give a crystalline resin (4) having a weight-average molecular weight Mw of 5,000 and a number-average molecular weight Mn of 2,500.

Then, 50 parts of the crystalline resin (4) is dissolved in 250 parts of ethyl acetate; a solution containing 2 parts of an anionic surfactant DOW-FAX in 300 parts of ion-exchange water is added thereto; the mixture is stirred in Ultra-Turrax at a frequency of 8,000 revolutions for 10 minutes; and removal of ethyl acetate gives a crystalline resin latex (4) having a volume-average particle diameter of 0.15 μm.

<Crystalline Resin (5) and its Emulsion>

A mixture of 1,500 parts of adipic acid, 920 parts of 1,4-butanediol, and 0.38 parts of dibutyltin oxide is stirred under nitrogen atmosphere at 180° C. for 6 hours. Then, the mixture is gradually heated to 200° C. under gradually decreasing pressure and stirred for 6 hours, to give a crystalline resin (5) having a weight-average molecular weight Mw of 27,200 and a number-average molecular weight Mn of 12,200.

Then, 50 parts of the crystalline resin (5) is dissolved in 250 parts of ethyl acetate; a solution containing 2 parts of an anionic surfactant DOW-FAX in 300 parts of ion-exchange water is added thereto; the mixture is stirred in Ultra-Turrax at a frequency of 8,000 revolutions for 10 minutes; and removal of ethyl acetate gives a crystalline resin latex (5) having a volume-average particle diameter of 0.15 μm.

<Amorphous Resin (1) and its Emulsion>

A mixture of 194 parts of dimethyl terephthalate, 194 parts of dimethyl isophthalate, 133.2 parts of dodecenylsuccinic anhydride, 228 parts of polyoxyethylene (2,0)-2,2-bis(4-hydroxyphenyl)propane, 585 parts of polyoxypropylene (2,2)-2,2-bis(4-hydroxyphenyl)propane, and 0.5 part of dibutyltin oxide is stirred under nitrogen atmosphere at 160° C. for 6 hours. Then, the mixture is gradually heated to 220° C. under gradually decreasing pressure and stirred for 6 hours; 15 parts of trimellitic anhydride is added thereto; the mixture is stirred approximately for 15 minutes under further reduced pressure, to give an amorphous resin (1) having a weight-average molecular weight Mw of 12,600 and a number-average molecular weight Mn of 5,500.

500 parts of the amorphous resin (1) is dissolved in 2,500 parts of ethyl acetate; a solution containing 20 parts of an anionic surfactant DOW-FAX in 3,000 parts of ion-exchange water is added thereto; the mixture is stirred in Ultra-Turrax at a frequency of 8,000 revolutions for 20 minutes; and removal of ethyl acetate gives an amorphous resin latex (1) having a volume-average particle diameter of 0.16 μm.

<Amorphous Resin (2) and its Emulsion>

A mixture of 90 parts of dimethyl terephthalate, 90 parts of dimethyl isophthalate, 103 parts of polyoxyethylene (2,0)-2,2-bis(4-hydroxyphenyl)propane, 117 parts of polyoxypropylene (2,2)-2,2-bis(4-hydroxyphenyl)propane, 29 parts of 1,9-nonanediol, and 0.25 part of dibutyltin oxide is stirred under nitrogen atmosphere at 160° C. for 6 hours. The mixture is then heated gradually to 220° C. under gradually decreasing pressure and stirred for 6 hours;

8 parts of trimellitic anhydride is added thereto; the mixture is stirred approximately for 15 minutes under further reduced pressure, to give an amorphous resin (2) having a weight-average molecular weight Mw of 11,500 and a number-average molecular weight Mn of 4,800.

500 parts of the amorphous resin (2) is dissolved in 2,500 parts of ethyl acetate; a solution containing 20 parts of an anionic surfactant DOW-FAX in 3,000 parts of ion-exchange water is added thereto; the mixture is stirred in Ultra-Turrax at a frequency of 8,000 revolutions for 20 minutes; and removal of ethyl acetate gives an amorphous resin latex (2) having a volume-average particle diameter of 0.14 μm.

<Amorphous Resin (3) and its Emulsion>

A mixture of 388 parts of dimethyl terephthalate, 194 parts of dimethyl isophthalate, 228 parts of polyoxyethylene (2,0)-2,2-bis(4-hydroxyphenyl)propane, 585 parts of polyoxypropylene (2,2)-2,2-bis(4-hydroxyphenyl)propane, and 0.5 part of dibutyltin oxide is stirred under nitrogen atmosphere at 160° C. for 6 hours. The mixture is then heated gradually to 220° C. under gradually decreasing pressure and stirred for 6 hours; 15 parts of trimellitic anhydride is added thereto; the mixture is stirred approximately for 15 minutes under further reduced pressure, to give an amorphous resin (3) having a weight-average molecular weight Mw of 10,400 and a number-average molecular weight Mn of 4,400.

500 parts of the amorphous resin (3) is dissolved in 2,500 parts of ethyl acetate; a solution containing 20 parts of an anionic surfactant DOW-FAX (manufactured by Dow Chemical Company) in 3,000 parts of ion-exchange water is added thereto; the mixture is stirred in Ultra-Turrax at a frequency of 8,000 revolutions for 20 minutes; and removal of ethyl acetate gives an amorphous resin latex (3) having a volume-average particle diameter of 0.14 μm.

<Preparation of Pigment Dispersion>

A mixture of the following composition is dissolved and dispersed in a homogenizer (Ultra-Turrax-50, manufactured by IKA) with ultrasonic wave irradiation, to give a dispersion of a blue pigment having a volume-average diameter of 150 nm.

Cyan Pigment C.I. Pigment Blue 15:3
(copper phthalocyanine, manufactured by Dainippon Ink and Chemicals, Inc.) 50 parts
Anionic surfactant Neogen SC 5 parts
Ion-exchange water 200 parts <Preparation of Releasing-agent Dispersion>

A mixture of the following composition is heated to 97° C. and dispersed in a homogenizer (Ultra-Turrax-50, manufactured by IKA). The dispersion is further pulverized into particles in a Gaulin homogenizer (manufactured by Meiwa Shoji Co., Ltd.) under the condition of 105° C. and 550 $kg/cm_2$ 20 times, to give a releasing-agent dispersion containing particles having a volume-average diameter of 190 nm.

Wax (WEP-5, manufactured by NOF Corporation) 25 parts
Anionic surfactant Neogen SC 5 parts
Ion-exchange water 200 parts Example 1

-Preparation of Electrophotographic Toner (1)-

The following composition is mixed and dispersed in a round stainless steel flask with a homogenizer (Ultra-Turrax-50, manufactured by IKA), and the dispersion in the flask is heated to 45° C. while stirred and kept at 45° C. for 30 minutes.

Crystalline resin latex (1) 80 parts
Crystalline resin latex (2) 80 parts
Amorphous resin latex (1) 500 parts
Ion-exchange water 200 parts
Pigment dispersion 20 parts
Releasing-agent dispersion 70 parts
10% Aqueous polyaluminum chloride solution (manufactured by Asada Chemicals) 1.5 parts Then, additional 140 parts of the amorphous resin latex (1) is added thereto, and the mixture is heated gradually to 55° C. Observation of the mixture under optical microscope reveals that aggregate particles having a particle diameter of approximately 6.7 μm are formed. The mixture is then adjusted to pH 9 by addition of an aqueous sodium hydroxide solution, and then heated to 90° C. for approximately 1 hour allowing fusion of the aggregates; after cooling, the resulting particles are filtered, washed thoroughly with ion-exchange water, and dried, to give an electrophotographic toner (1). The particle diameter of the electrophotographic toner (1) is 6.6 μm (volume-average diameter), as determined by the Coulter Counter described above. The GSDv thereof, an indicator of volumetric particle diameter distribution, is 1.23.

-Preparation of Developer (1)-

0.5% of hexamethyldisilazane-treated silica (average diameter: 40 nm) and 0.7% of a titanium compound (average diameter: 30 nm) prepared by adding 50% isobutyltrimethoxylsilane to metatitanic acid and burning the mixture (respectively, weight ratios with respect to the toner) are added to the toner (1) particles as external additives, and the mixture is blended in a 75-L Henschel Mixer for 10 minutes, and then screened in an air classifier High Bolter 300 (manufactured by Shin-Tokyo Kikai Co., Ltd.), to give an external additive-added toner.

0.15 Part of vinylidene fluoride and 1.35 parts of a copolymer of methyl methacrylate and trifluoroethylene (polymerization ratio: 80:20) are coated in a kneader with respect to 100 parts of a ferrite core having an average diameter of 50 μm, to give a carrier. The carrier obtained and the externally added toner are blended in a 2-L V blender at a ratio of 100 parts to 8 parts, to give a developer (1).

-Evaluation- (Evaluation of Low-temperature Fixing Efficiency)

An image is formed on color paper (J paper) manufactured by Fuji Xerox Co., Ltd. at a toner load controlled to 13.5 g/m$^2$, by using the developer (1) prepared and a modified machine of DocuCentreColor500 (modified to fix images in an external fixing device at variable fixing temperatures) manufactured by Fuji Xerox Co., Ltd. The image formed is fixed in an external fixing device having a nip width of 6.5 mm, at a fixing speed of 180 mm/sec.

In the fixing test, the image formed is fixed at an increasing fixing-roll fixing temperature from 90° C. at an interval of +5° C., for evaluation of the mimimum fixing temperature. The paper carrying the fixed image is folded into two, at the position almost at the center of the solid area of image, and the region where the fixed toner image is broken down is wiped with tissue paper; and the width of the resulting whitened line is determined. The fixing temperature at which the whitened line width becomes 0.5 mm or less is designated as the lowest fixing temperature (MFT). Evaluation results are summarized in Table 2.

(Evaluation of Crease)

An image is formed and fixed in a similar manner to the evaluation of the low-temperature fixing efficiency, except that the fixing temperature is kept constant at 130° C.; the paper is also folded, and the width of whitened line is determined; and the strength of the fixed image is evaluated according to the following criteria:Δ, a whitened line width of more than 0.4 mm; ○, 0.4 to 0.2 mm; and ◎, less than 0.2 mm. Evaluation results are summarized in Table 2.

(Evaluation of Glossiness)

An image is formed in a similar manner to the evaluation of the low-temperature fixing efficiency, except that the paper is changed to a mirror coated paper manufactured by Fuji Xerox Co., Ltd. and the image is fixed at a fixing temperature kept constant at 130° C.; and the 60-degree glossiness of the image is determined by using a gross meter (trade name: MicroTRIGloss, manufactured by Gardner). Evaluation results are summarized in Table 2.

(Amount of Toner Electrostatic Charge)

1.5 parts of the electrophotographic toner (1) and 30 parts of the carrier prepared during preparation of the developer (1) above are allow to stand in high-temperature high-humidity environment (room controlled at a temperature of 28° C. and a humidity of 85% RH) respectively for one day. Then, they are mixed and agitated in a Turbula stirrer for 60 minutes, and the amount of electrostatic charge thereon is determined by using Blowoff Tribo Analyzer (manufactured by Toshiba Corp.). Evaluation results are summarized in Table 2.

(Evaluation of Filming)

An image is printed on 50,000 papers under an environment of 28° C. and 80% RH by using DCC500 (manufactured by Fuji Xerox Co., Ltd.) and the developer (1). Deposits on the photosensitive drum after printing is observed visually and evaluated according to the following criteria: Evaluation results are summarized in Table 2.

A: No deposit confirmed on photosensitive drum

B: Slight deposit confirmed on photosensitive drum

C: Slight deposit grown in streaks observable on photosensitive drum

D: Deposit present on the entire area of photosensitive drum

Example 2

-Preparation of Electrophotographic Toner (2)-

An electrophotographic toner (2) is prepared in a similar manner to toner (1), except that the toner composition used in preparing the toner in Example 1 is changed to the following composition, and a developer is prepared and evaluated similarly. The volume-average diameter of the toner is 6.8 μm, and the GSDv 1.24.

Crystalline resin latex (3) 80 parts
Crystalline resin latex (2) 80 parts
Amorphous resin latex (1) 500 parts
Ion-exchange water 200 parts
Pigment dispersion 20 parts
Releasing-agent dispersion 70 parts
10% Aqueous polyaluminum chloride solution (manufactured by Asada Chemicals) 1.5 parts
Additional amorphous resin latex (1) 140 parts Example 3

-Preparation of Electrophotographic Toner (3)-

An electrophotographic toner (3) is prepared in a similar manner to toner (1), except that the toner composition used in preparing the toner in Example 1 is changed to the following composition, and a developer is prepared and evaluated similarly. The volume-average diameter of the toner is 6.7 μm, and the GSDv 1.23.

Crystalline resin latex (4) 80 parts
Crystalline resin latex (2) 80 parts
Amorphous resin latex (2) 430 parts
Ion-exchange water 200 parts
Pigment dispersion 20 parts
Releasing-agent dispersion 70 parts
10% Aqueous polyaluminum chloride solution (manufactured by Asada Chemicals) 1.5 parts
Additional amorphous resin latex (3) 210 parts Example 4

-Preparation of Electrophotographic Toner (4)-

An electrophotographic toner (4) is prepared in a similar manner to toner (1), except that the toner composition used in preparing the toner in Example 1 is changed to the following composition, and a developer is prepared and evaluated similarly. The volume-average diameter of the toner is 6.9 μm, and the GSDv 1.23.

Crystalline resin latex (4) 80 parts
Crystalline resin latex (2) 80 parts
Amorphous resin latex (1) 500 parts
Ion-exchange water 200 parts
Pigment dispersion 20 parts
Releasing-agent dispersion 70 parts
10% Aqueous polyaluminum chloride solution (manufactured by Asada Chemicals) 1.5 parts
Additional amorphous resin latex (1) 140 parts Example 5

-Preparation of Electrophotographic Toner (5)-

An electrophotographic toner (5) is prepared in a similar manner to toner (1), except that the toner composition used in preparing the toner in Example 1 is changed to the following composition, and a developer is prepared and evaluated similarly. The volume-average diameter of the toner is 6.7 μm, and the GSDv 1.23.

In the following toner composition, crystalline resin latex (5) is prepared as follows: a mixture of 250 parts of the crystalline resin (1) and 250 parts of the crystalline resin (2) is dissolved in 2,500 parts of ethyl acetate; a solution containing 20 parts of an anionic surfactant DOW-FAX in 3,000 parts of ion-exchange water is added thereto; the mixture is stirred in Ultra-Turrax at a frequency of 8,000 revolutions for 20 minutes; and removal of ethyl acetate gives a crystalline resin latex (5) having a volume-average particle diameter of 0.15 μm.

Crystalline resin latex (5) 160 parts
(crystalline resins (1) and (2))
Amorphous resin latex (1) 500 parts
Ion-exchange water 200 parts
Pigment dispersion 20 parts
Releasing-agent dispersion 70 parts
10% Aqueous polyaluminum chloride solution (manufactured by Asada Chemicals) 1.5 parts
Additional amorphous resin latex (1) 140 parts Comparative Example 1

-Preparation of Electrophotographic Toner (6)-

An electrophotographic toner (6) is prepared in a similar manner to toner (1), except that the toner composition used in preparing the toner in Example 1 is changed to the following composition, and a developer is prepared and evaluated similarly. The volume-average diameter of the toner is 6.8 μm, and the GSDv 1.25.

Crystalline resin latex (1) 160 parts
Amorphous resin latex (1) 500 parts
Ion-exchange water 200 parts
Pigment dispersion 20 parts
Releasing-agent dispersion 70 parts
10% Aqueous polyaluminum chloride solution (manufactured by Asada Chemicals) 1.5 parts
Additional amorphous resin latex (1) 140 parts Comparative Example 2

-Preparation of Electrophotographic Toner (7)-

An electrophotographic toner (7) is prepared in a similar manner to toner (1), except that the toner composition used in preparing the toner in Example 1 is changed to the following composition, and a developer is prepared and evaluated similarly. The volume-average diameter of the toner is 6.5 μm, and the GSDv 1.23.

Crystalline resin latex (2) 160 parts
Amorphous resin latex (1) 500 parts
Ion-exchange water 200 parts
Pigment dispersion 20 parts
Releasing-agent dispersion 70 parts
10% Aqueous polyaluminum chloride solution (manufactured by Asada Chemicals) 1.5 parts
Additional amorphous resin latex (1) 140 parts Comparative Example 3

-Preparation of Electrophotographic Toner (8)-

An electrophotographic toner (8) is prepared in a similar manner to toner (1), except that the toner composition used in preparing the toner in Example 1 is changed to the following composition, and a developer is prepared and evaluated similarly. The volume-average diameter of the toner is 6.6 μm, and the GSDv 1.25.

Crystalline resin latex (3) 160 parts
Amorphous resin latex (1) 500 parts
Ion-exchange water 200 parts
Pigment dispersion 20 parts
Releasing-agent dispersion 70 parts
10% Aqueous polyaluminum chloride solution (manufactured by Asada Chemicals) 1.5 parts
Additional amorphous resin latex (1) 140 parts Comparative Example 4

-Preparation of Electrophotographic Toner (9)-

An electrophotographic toner (9) is prepared in a similar manner to toner (1), except that the toner composition used in preparing the toner in Example 1 is changed to the following composition, and a developer is prepared and evaluated similarly. The volume-average diameter of the toner is 6.7 μm, and the GSDv 1.24.

Crystalline resin latex (2) 40 parts
Amorphous resin latex (1) 660 parts
Ion-exchange water 241 parts
Pigment dispersion 20 parts
Releasing-agent dispersion 70 parts
10% Aqueous polyaluminum chloride solution (manufactured by Asada Chemicals) 1.5 parts
Additional amorphous resin latex (1) 160 parts Comparative Example 5

-Preparation of Electrophotographic Toner (10)-

An electrophotographic toner (10) is prepared in a similar manner to toner (1), except that the toner composition used in preparing the toner in Example 1 is changed to the following composition, and a developer is prepared and evaluated similarly. However, the crease and the glossiness are not evaluated, because it is not possible to obtained a fixed image at a fixing temperature of 130° C. The volume-average diameter of the toner is 6.7 μm, and the GSDv 1.22.

Amorphous resin latex (1) 740 parts
Ion-exchange water 280 parts
Pigment dispersion 20 parts
Releasing-agent dispersion 70 parts
10% Aqueous polyaluminum chloride solution (manufactured by Asada Chemicals) 1.5 parts
Additional amorphous resin latex (1) 140 parts Comparative Example 6

-Preparation of Electrophotographic Toner (11)-

An electrophotographic toner (11) is prepared in a similar manner to toner (1), except that the toner composition used in preparing the toner in Example 1 is changed to the following composition, and a developer is prepared and evaluated similarly. The volume-average diameter of the toner is 6.7 μm, and the GSDv 1.24.

Crystalline resin latex (2) 640 parts
Ion-exchange water 240 parts
Pigment dispersion 20 parts
Releasing-agent dispersion 70 parts
10% Aqueous polyaluminum chloride solution (manufactured by Asada Chemicals) 1.5 parts
Additional amorphous resin latex (1) 140 parts Properties of the binder resin in each of the electrophotographic toners obtained in the Examples and Comparative Examples (ester concentration in the binder and crystalline resins used, content ratio of each resin in the total binder resin components, weight-average molecular weight Mw and number-average molecular weight Mn of each resin,) are summarized in Tables 1(1) and 1(2). Evaluation results of each toner are summarized in Table 2.

TABLE 1

| | | Binder resin | | Ester concentration | Content ratio in binder resin components | Mw | Mn |
|---|---|---|---|---|---|---|---|
| Example 1 | Core region | Crystalline resin | (1) | 0.083 | 10% | 4900 | 2300 |
| | | | (2) | 0.083 | 10% | 26600 | 11200 |
| | | Amorphous resin | (1) | | 80% | 12600 | 5500 |
| | Shell region | Amorphous resin | (1) | | | 12600 | 5500 |
| Example 2 | Core region | Crystalline resin | (3) | 0.11 | 10% | 5000 | 2500 |
| | | | (2) | 0.083 | 10% | 26600 | 11200 |
| | | Amorphous resin | (1) | | 80% | 12600 | 5500 |
| | Shell region | Amorphous resin | (1) | | | 12600 | 5500 |
| Example 3 | Core region | Crystalline resin | (4) | 0.167 | 10% | 5000 | 2500 |
| | | | (2) | 0.083 | 10% | 26600 | 11200 |
| | | Amorphous resin | (2) | | 55% | 11500 | 4800 |
| | Shell region | Amorphous resin | (3) | | 25% | 10400 | 4400 |
| Example 4 | Core region | Crystalline resin | (4) | 0.167 | 10% | 5000 | 2500 |
| | | | (2) | 0.083 | 10% | 26600 | 11200 |
| | | Amorphous resin | (1) | | 80% | 12600 | 5500 |
| | Shell region | Amorphous resin | (1) | | | 12600 | 5500 |
| Example 5 | Core region | Crystalline resin | (1) | 0.083 | 10% | 4900 | 2300 |
| | | | (2) | 0.083 | 10% | 26600 | 11200 |
| | | Amorphous resin | (1) | | 80% | 12600 | 5500 |
| | Shell region | Amorphous resin | (1) | | | 12600 | 5500 |
| Comparative Example 1 | Core region | Crystalline resin | (1) | 0.083 | 20% | 4900 | 2300 |
| | | Amorphous resin | (1) | | 80% | 12600 | 5500 |
| | Shell region | Amorphous resin | (1) | | | 12600 | 5500 |
| Comparative Example 2 | Core region | Crystalline resin | (2) | 0.083 | 20% | 26600 | 11200 |
| | | Amorphous resin | (1) | | 80% | 12600 | 5500 |
| | Shell region | Amorphous resin | (1) | | | 12600 | 5500 |
| Comparative Example 3 | Core region | Crystalline resin | (3) | 0.11 | 20% | 5000 | 2500 |
| | | Amorphous resin | (1) | | 80% | 12600 | 5500 |
| | Shell region | Amorphous resin | (1) | | | 12600 | 5500 |
| Comparative Example 4 | Core region | Crystalline resin | (2) | 0.083 | 5% | 26600 | 11200 |
| | | Amorphous resin | (1) | | 95% | 12600 | 5500 |
| | Shell region | Amorphous resin | (1) | | | 12600 | 5500 |
| Comparative Example 5 | Core region | Crystalline resin | — | | | | |
| | | Amorphous resin | (1) | | 100% | 12600 | 5500 |
| | Shell region | Amorphous resin | (1) | | | 12600 | 5500 |
| Comparative Example 6 | Core region | Crystalline resin | (2) | 0.083 | 80% | 26600 | 11200 |
| | | Amorphous resin | — | | | | |
| | Shell region | Amorphous resin | (1) | | 20% | 12600 | 5500 |

TABLE 2

| | Low-temperature fixing efficiency (° C.) | Crease | Glossiness (%) | Toner electrostatic charging amount (μC/g) | Filming |
|---|---|---|---|---|---|
| Example 1 | 110 | A | 58 | −45 | B |
| Example 2 | 105 | A | 64 | −40 | B |
| Example 3 | 110 | A | 55 | −46 | A |
| Example 4 | 105 | A | 60 | −35 | B |
| Example 5 | 105 | A | 60 | −44 | B |
| Comparative Example 1 | 100 | C | 50 | −45 | B |
| Comparative Example 2 | 115 | A | 45 | −40 | B |
| Comparative Example 3 | 100 | C | 40 | −38 | B |
| Comparative Example 4 | 130 | C | 22 | −46 | B |
| Comparative Example 5 | 140 | — | — | −48 | A |
| Comparative Example 6 | 100 | A | 45 | −37 | D |

As apparent from the results in Table 2, the toner according to the invention enables a low-temperature fixation, provides a high glossy image after fixing at the low temperature and a high resistance to folding, causes almost no or only slight filming on the photosensitive body after operation under a highly humid condition, and enables continuous printing of high-quality images.

The toner also provides a highly glossy image and a high resistance to bending, as compared with the toners in which a low-molecular weight resin is used as the crystalline resin (Comparative Examples 1 and 3), and provides a highly glossy image and enables fixation at a lower temperature, as compared with the toners in which only a high-molecular weight resin is used as the crystalline resin (Comparative Examples 2, 4 and 6).

Thus, the invention provides an electrophotographic toner having a preferable low-temperature fixing property and giving a high strength and highly glossy image, and a production method thereof, and an electrophotographic developer and an image-forming process using the electrophotographic toner.

What is claimed is:

1. An electrophotographic toner, comprising a binder resin containing a coloring agent, a crystalline resin and an amorphous resin, wherein the crystalline resin has two or more peaks in weight-average molecular weight as determined by gel permeation chromatography, one of the peaks has a weight-average molecular weight in the range of 15,000 to 40,000, and another peak has a weight-average molecular weight in the range of 2,000 to 10,000.

2. The electrophotographic toner according to claim 1, wherein the crystalline resin contains a high-molecular weight resin having a peak in the weight-average molecular weight range of 15,000 to 40,000, a low-molecular weight resin having a peak in the weight-average molecular weight range of 2,000 to 10,000, and the high- and low-molecular weight resins are prepared respectively from different monomers.

3. The electrophotographic toner according to claim 1, wherein the crystalline resin is an aliphatic polyester.

4. The electrophotographic toner according to claim 3, wherein the ester concentration of the crystalline polyester represented by the following Formula 1 is 0.01 or more and 0.1 or less:

$$M=K/A \quad \text{(Formula 1)}$$

wherein in Formula 1, M represents an ester concentration, K represent the number of ester groups in the resin, and A represents the number of atoms constituting the polymer chain in the resin.

5. The electrophotographic toner according to claim 1, wherein the amorphous resin is a polyester.

6. The electrophotographic toner of according to claim 5, wherein the amorphous polyester resin has a weight-average molecular weight Mw of from 5,000 to 40,000 and a number-average molecular weight Mn of from 2,000 to 10,000.

7. The electrophotographic toner of according to claim 5, wherein the amorphous polyester resin has a glass transition temperature of 30° C. to 80° C.

8. The electrophotographic toner according to claim 1, wherein the content of the amorphous resin is a resin polymerized by a monomer having a vinyl group.

9. The electrophotographic toner according to claim 8, wherein the resin polymerized by a monomer having a vinyl group has a weight average molecular weight Mw of from 20,000 to 100,000 and a number average molecular weight Mn of from 2,000 to 30,000.

10. The electrophotographic toner according to claim 1, wherein the content of the crystalline resin is 5% or more and 35% or less by weight with respect to the total amount of the binder resin.

11. The electrophotographic toner according to claim 1, wherein the toner is prepared by an aggregation process in which aggregated particles containing crystalline particles and amorphous particles are formed in a dispersion containing the crystalline particles and the amorphous particles.

12. An electrophotographic developer employing a carrier containing a magnetic body and the electrophotographic toner according to claim 1.

13. The electrophotographic developer according to claim 12, wherein the carrier is coated with a resin, the amount of coated resin being 0.1 to 10 parts by weight relative to 100 parts of the magnetic body.

14. An image-forming process employing the electrophotographic toner of claim 1, wherein the process comprises:

a latent image forming step of forming an electrostatic latent image on the surface of a latent image-holding member, a developing step of forming a toner image by developing the electrostatic latent image formed on the surface of the latent image carrier with a developer containing a toner, a transferring process of transferring the toner image formed on the surface of the latent image carrier onto the surface of an image-receiving member, and a fixing step of thermally fusing the toner image transferred on the surface of the image-receiving member, wherein the toner is an electrophotographic toner according to claim 1.

* * * * *